US011024110B2

(12) United States Patent
Uehata

(10) Patent No.: US 11,024,110 B2
(45) Date of Patent: Jun. 1, 2021

(54) PRODUCT STORAGE DEVICE

(71) Applicants: SANDEN RETAIL SYSTEMS CORPORATION, Isesaki (JP); THE COCA-COLA COMPANY, Atlanta, GA (US)

(72) Inventor: Yugo Uehata, Isesaki (JP)

(73) Assignees: SANDEN RETAIL SYSTEMS CORPORATION, Isesaki (JP); THE COCA-COLA COMPANY, Atlanta, GA (US)

( * ) Notice: Subject to any disclaimer, the term of this patent is extended or adjusted under 35 U.S.C. 154(b) by 225 days.

(21) Appl. No.: 16/071,823

(22) PCT Filed: Jul. 19, 2016

(86) PCT No.: PCT/JP2016/071181
§ 371 (c)(1),
(2) Date: Sep. 11, 2018

(87) PCT Pub. No.: WO2017/126140
PCT Pub. Date: Jul. 27, 2017

(65) Prior Publication Data

US 2021/0049855 A1 Feb. 18, 2021

(30) Foreign Application Priority Data

Jan. 21, 2016 (JP) ..... JP2016-010132

(51) Int. Cl.
*G07F 9/00* (2006.01)
*G07F 9/02* (2006.01)
*G07F 9/10* (2006.01)

(52) U.S. Cl.
CPC ..... *G07F 9/006* (2013.01); *G07F 9/02* (2013.01); *G07F 9/105* (2013.01)

(58) Field of Classification Search
CPC ..... G07F 9/105; G07F 9/006
(Continued)

(56) References Cited

U.S. PATENT DOCUMENTS 6,389,822 B1 * 5/2002 Schanin ..... F25D 29/00 62/89
8,708,193 B1 * 4/2014 Davis ..... G07F 7/08 221/150 R (Continued)

FOREIGN PATENT DOCUMENTS

JP 50-074500 A 6/1975
JP 02-148386 A 6/1990

(Continued)

OTHER PUBLICATIONS

Translation of JP 11-224370 (Year: 1999).*

(Continued)

*Primary Examiner* — Timothy R Waggoner
(74) *Attorney, Agent, or Firm* — Baker Botts L.L.P.

(57) ABSTRACT

A product storage device (1) includes: first and second product storage chambers (52, 53) for storing products and for cooling or heating the stored products; a product delivery port (31) to which a product stored in the first or second product storage chamber (52, 53) is dispensed; and a control unit (10) configured to set one of the first and second product storage chambers (52, 53) as a preliminary chamber in which stored products are not available for dispensing and set the other as a product dispensing chamber in which stored products are available for dispensing, and configured to sequentially change product storage chambers to be set as the preliminary chamber.

10 Claims, 7 Drawing Sheets

(58) Field of Classification Search
USPC ..... 221/9–11, 92–133, 150 R, 17; 700/231–244
See application file for complete search history.

(56) References Cited

U.S. PATENT DOCUMENTS

| | | | | |
|---|---|---|---|---|
| 2008/0142537 | A1* | 6/2008 | Howell | G07F 9/026 221/112 |
| 2015/0241693 | A1* | 8/2015 | Macquet | G02B 27/0101 359/630 |
| 2017/0241693 | A1* | 8/2017 | Tajika | F25B 47/022 |
| 2017/0287258 | A1* | 10/2017 | Gerhard | G06Q 30/0639 |

FOREIGN PATENT DOCUMENTS

| | | | |
|---|---|---|---|
| JP | 04-275699 | A | 10/1992 |
| JP | 05-073767 | A | 3/1993 |
| JP | 08-263737 | A | 10/1996 |
| JP | 09-007053 | A | 1/1997 |
| JP | 11-224370 | A | 8/1999 |
| JP | 2000-182134 | A | 6/2000 |
| JP | 2003-109074 | A | 4/2003 |
| JP | 2013-235432 | A | 11/2013 |
| JP | 2014-215870 | A | 11/2014 |

OTHER PUBLICATIONS

Translation of JP 02-148386 (Year: 1990).*
Korean Intellectual Property Office, Office Action issued in Korean Patent Application No. 10-2018-0723954, dated Mar. 26, 2020.
Patent Office of Japan; Notification of Reasons for Refusal issued in Japanese Patent Application No. 2016-010132, dated Dec. 17, 2019.
Japan Patent Office, International Search Report issued in International Application No. PCT/JP2016/071181, dated Oct. 25, 2016.
The International Bureau of WIPO, International Preliminary Report on Patentability (Chapter I) issued in International Application No. PCT/JP2016/071181, dated Aug. 2, 2018.
Korean Intellectual Property Office, Office Action issued in Korean Patent Application No. 10-2018-7023954, dated Mar. 26, 2020.
Korean Intellectual Property Office, Notification of Reason for Refusal, issued in Korean Application No. KR 10-2018-7023954, dated Sep. 16, 2019.
Japan Patent Office, Notice of Reasons for Refusal, issued in Japanese Application No. JP 2016-010132, dated Oct. 1, 2019.

* cited by examiner

PRODUCT STORAGE DEVICE

CROSS-REFERENCE TO RELATED APPLICATIONS

This application is a U.S. National Stage Patent Application under 37 U.S.C. § 371 of International Patent Application No. PCT/JP2016/071181, filed on Jul. 19, 2016, which claims the benefit of Japanese Patent Application No. JP 2016-010132, filed on Dec. 21, 2016, the disclosures of each of which are incorporated herein by reference in their entirety.

TECHNICAL FIELD

The present invention relates to a product storage device configured to cool or heat products stored therein and to dispense a stored product to a product delivery port.

BACKGROUND ART

As an example of such a product storage device, a vending machine is known. In most vending machines, a product accommodation space is reloaded with new products when products are sold out, and the loaded products are then cooled or heated. Until the temperatures of the loaded products become suitable, the sale of products (or dispensing of products) is stopped (see, for example, Patent Document 1).

REFERENCE DOCUMENT LIST

Patent Document

Patent Document 1: JP H05-073767 A

SUMMARY OF THE INVENTION

Problem to be Solved by the Invention

Such stopping of the sale (or dispensing) of products until the temperatures of loaded products become suitable might lead unfavorably to the loss of sales opportunities for products. For example, in order to prevent such stopping of sale (or dispensing) of products, one strategy may be loading products as appropriate before stored products are sold out.

However, because such products to be loaded have not been cooled or heated, the loading of products might change the temperature inside the product accommodation space. Thus, there is a concern that if a range of suitable temperatures for products is narrow, stored products which have already had suitable temperatures might fall outside the suitable temperature range and a product having the temperature outside the suitable temperature range might be dispensed.

Thus, an object of the present invention is to provide a product storage device capable of continuously dispensing products having a suitable temperature even when the suitable temperature range of products is narrow.

Means for Solving the Problem

According to an aspect of the present invention, a product storage device comprises: a plurality of product storage chambers for storing products and for cooling or heating the stored products;

a product delivery port to which a product stored in the plurality of product storage chambers is dispensed; and a control unit configured to set at least one, but not all, of the plurality of product storage chambers as a preliminary chamber in which stored products are not available for dispensing and set the remainder as a product dispensing chamber in which stored products are available for dispensing, and configured to sequentially change product storage chambers to be set as the preliminary chamber.

Effects of the Invention

In the abovementioned product storage device, a product storage chamber which has been set as the preliminary chamber is then switched to the product dispensing chamber, and a product storage chamber which has been set as the product dispensing chamber is then switched to the preliminary chamber. Thus, by changing product storage chambers to be set as the preliminary chamber by the control unit at an appropriate timing, and by reloading a product storage chamber which is newly set as the preliminary chamber in association with the change (i.e., the change of product storage chamber to be set as the preliminary chamber) with products, it is possible to continuously dispense products having a suitable temperature even when the suitable temperature range of products is narrow.

MODE FOR CARRYING OUT THE INVENTION

Hereinbelow, embodiments of the present invention will be described with reference to the accompanying drawings. A product storage device according to an embodiment stores several types of products (mainly corresponding to bottled beverages), and cools or heats the stored products. Furthermore, the product storage device according to the present embodiment is configured to read product information recorded in an information storage medium such as a card, and then to dispense a product which corresponds to the read product information from the stored products. As used herein, the information storage medium such as a card is referred to as "product designation card". Although not subject to any particular limitation, according to the present embodiment, money information is not recorded in the information storage medium such as a card (product designation card), and the product storage device does not perform financial processing such as balance inquiry, rewriting of the balance, or the like, when dispensing a product.

Figure 1:
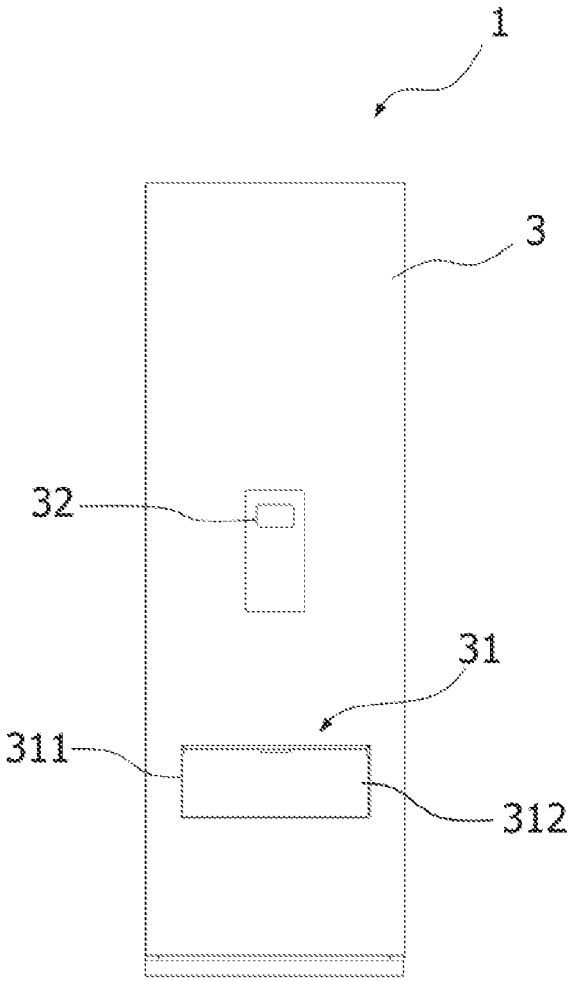
FIG. 1 is a front view of a product storage device according to an embodiment of the present invention.
Figure 2:
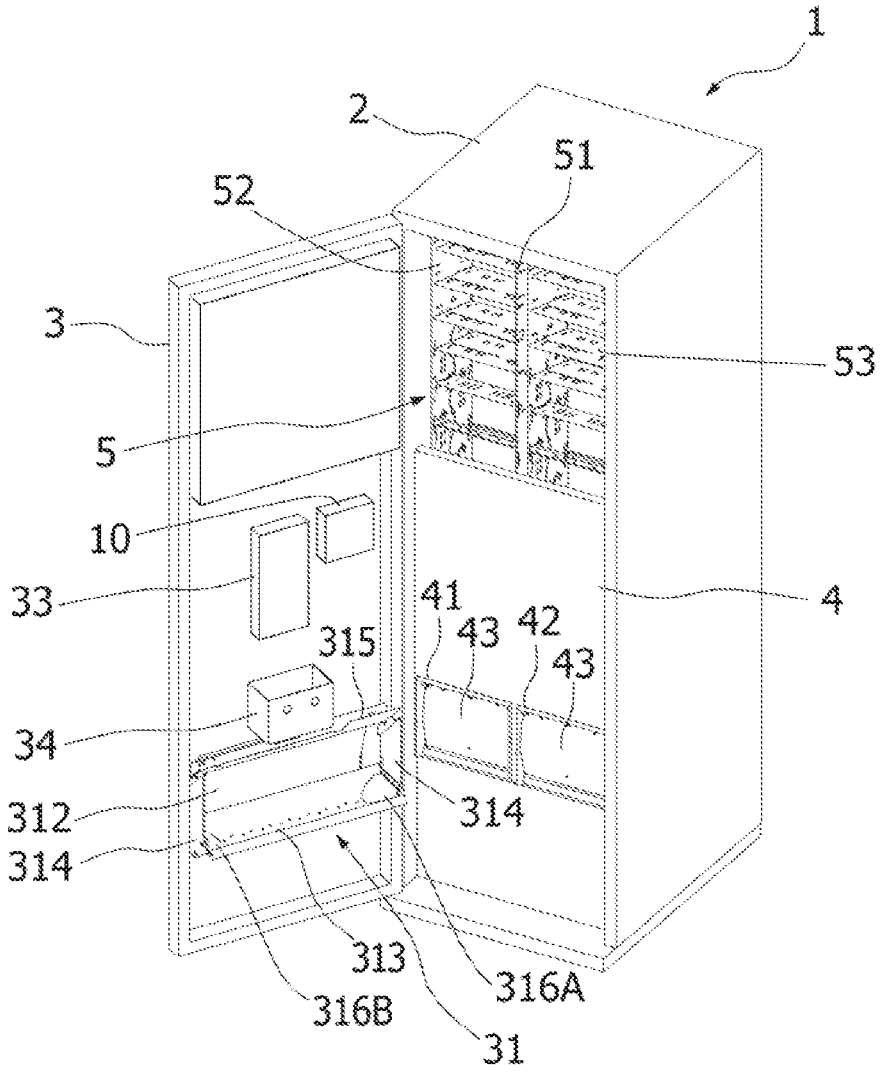
FIG. 2 is a perspective view illustrating the interior (in a state in which an outer door is open) of the product storage device.

FIG. 1 is a front view of a product storage device 1 according to the embodiment of the present invention, and FIG. 2 is a perspective view illustrating the interior of the product storage device 1 (in a state in which an outer door 3, described below, is open). The product storage device 1 includes a box-shaped device body 2 with the front face open, the outer door 3 that opens and closes the front face of the device body 2, and an inner door 4 arranged inside the outer door 3.

The device body 2 includes thereinside a product storage space 5 with a heat insulation structure. The interior of the product storage space 5 is partitioned by a partition wall 51 into a first product storage chamber 52 and a second product storage chamber 53 arranged side by side in the width direction (right-and-left direction) of the product storage device 1. The first product storage chamber 52 is located on the left side when viewed from the front, and the second product storage chamber 53 is located on the right side when viewed from the front. In the present embodiment, the first and second product storage chambers 52, 53 have substantially the same shape and configuration, and each of the first and second product storage chambers 52, 53 is configured to be capable of storing products P and cooling or heating the stored products. Furthermore, in the present embodiment, the interior of the first product storage chamber 52 and that of the second product storage chamber 53 are basically maintained at the same temperature (set temperature).

Figure 3:
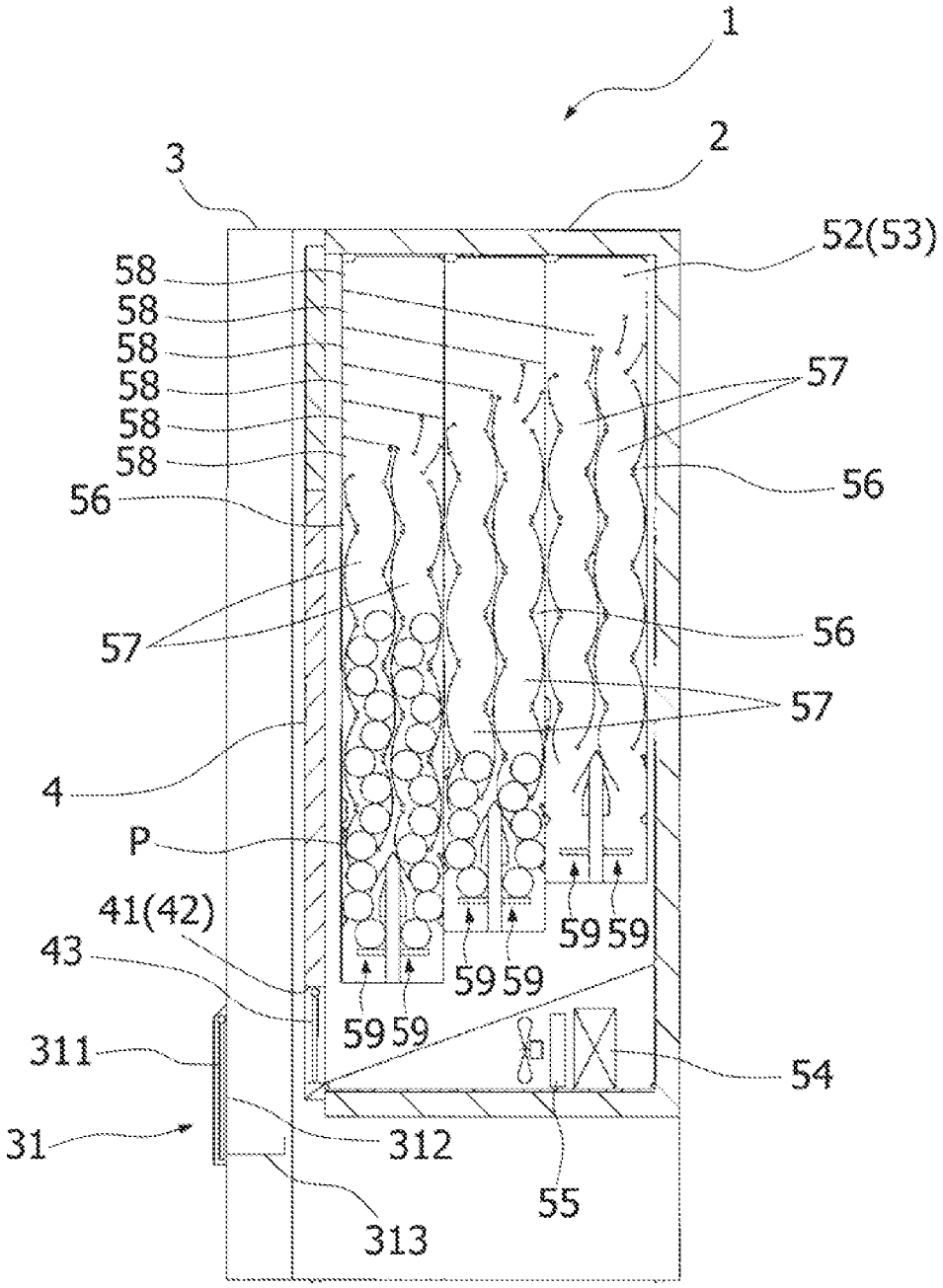
FIG. 3 is a cross-sectional view of the side of the product storage device.

FIG. 3 is a cross-sectional view of the side of the product storage device 1, and mainly illustrates the interior structure of the first and second product storage chambers 52, 53. The first product storage chamber 52 (the same applies to the second product storage chamber 53) is provided with a cooling device 54 for cooling the interior of the first product storage chamber 52 (second product storage chamber 53), and a heating device 55 for heating the interior of the first product storage chamber 52 (second product storage chamber 53). In the present embodiment, the cooling device 54 is an evaporator that is a component of a refrigeration-cycle device (not illustrated), and the heating device 55 is a heater.

Furthermore, in the first product storage chamber 52 (the same applies to the second product storage chamber 53), a plurality of (in this case, three) product storage columns 56 arranged forward and backward are disposed. Each product storage column 56 includes a pair of product passages 57 extending in the vertical direction. Products P are stored in each product passage 57 by being loaded by an operator or the like from the corresponding product-loading port 58 located at the upper portion of the product storage column 56. Here, each product passage 57 is allocated a type of product P, and each product passage 57 stores products P with the same type. At the lower portion of each product storage column 56, two product dispensing devices 59, corresponding to the pair of product passages 57, are located back to back. Each product dispensing device 59 makes products P sequentially dropped in a manner such that a product P which is positioned on the lowermost of products P stored one above the other in the vertical direction in the corresponding product passage 57, is dropped first.

The outer door 3 is rotatably attached to one end side of the device body 2 in the width direction (right-and-left direction) of the product storage device 1 (in this case, attached at the left side when viewed from the front). At the lower portion of the outer door 3, there is provided a product delivery port 31 to which a product dropped by a product dispensing device 59 is dispensed. The product delivery port 31 will be described below. On the front (outer face) of the outer door 3, there is provided a card inlet 32 through which the product designation card is inserted, and on the back (inner face) of the outer door 3, there are provided a card reader/writer 33 that reads product information recorded in the product designation card and/or writes predetermined information into the product designation card, and a card collection box 34 for collecting the product designation card.

The inner door 4 has a heat insulation structure, covers an opening of the product storage space 5, and is configured to be capable of opening and closing the opening. At the lower portion of the inner door 4, there are provided a first product dispensing opening 41 that provides communication between the interior of the first product storage chamber 52 and the product delivery port 31, and a second product dispensing opening 42 that provides communication between the interior of the second product storage chamber 53 and the product delivery port 31. The first and second product dispensing openings 41, 42 correspond to the first and second product storage chambers 52, 53, respectively, and are arranged side by side in the width direction (right-and-left direction) of the product storage device 1. A product P dropped by the product dispensing device 59 inside the first product storage chamber 52, that is, a product P stored in the first product storage chamber 52 is dispensed to the product delivery port 31 through the first product dispensing opening 41, and a product P dropped by the product dispensing device 59 inside the second product storage chamber 53, that is, a product P stored in the second product storage chamber 53 is dispensed to the product delivery port 31 through the second product dispensing opening 42. Here, each of the first and second product dispensing openings 41, 42 is provided with a dispensing flap 43 to reduce a decrease in heat-insulation performance. For example, the dispensing flap 43 is configured to be pushed open by a product dropped by a product dispensing device 59 and closed by its own weight.

The product delivery port 31 includes an opening 311 that opens at the front lower portion of the outer door 3, an opening/closing flap 312 for opening and closing the opening 311, and a product receiving portion 313 for receiving a product P dispensed through the first or second product dispensing opening 41, 42.

The opening 311 is formed in a substantially rectangular shape extending in the width direction (right-and-left direction) of the product storage device 1. The opening/closing flap 312 is made of a transparent plate of synthetic resin or the like, and has the upper end rotatably supported near the upper portion of the opening 311. The opening/closing flap 312 is configured to open the opening 311 by rotating forward the lower end of the opening/closing flap 312, and to close the opening 311 by its own weight. The product receiving portion 313 is formed in a shallow dish-like shape made of a sheet metal member or the like. The product receiving portion 313 has a width-direction dimension greater than that of the opening 311, and is secured to the outer door 3 so as to be located below the opening 311 on the back side of the outer door 3. On the upper face of the product receiving portion 313, there is provided a cushioning material (not illustrated) for absorbing an impact when receiving a dispensed product. In addition, to each of both right and left ends of the product receiving portion 313, a side plate 314 extending to a point slightly above the upper portion of the opening 311 is attached. To the upper portion of both side plates 314, 314, an upper face plate 315 inclined downward toward the front is attached.

At both right and left side portions inside the product delivery port 31, there is provided a pair of illumination devices 316A, 316B for illuminating the interior of the product delivery port 31. Specifically, in the width direction (right-and-left direction) of the product storage device 1, one illumination device 316A is disposed at one end side (at the left side when viewed from the front, or the right side when viewed from the back) of the upper face of the product receiving portion 313, and the other illumination device 316B is disposed at the other end side (at the right side when viewed from the front, or the left side when viewed from the back) of the upper face of the product receiving portion 313. The pair of illumination devices 316A, 316B may have any shapes, any structures, and the like, as long as it can illuminate the interior of the product delivery port 31. For example, each illumination device 316A, 316B may be configured to include a light source such as an LED, and a translucent casing for accommodating therein the light source.

Figure 4:
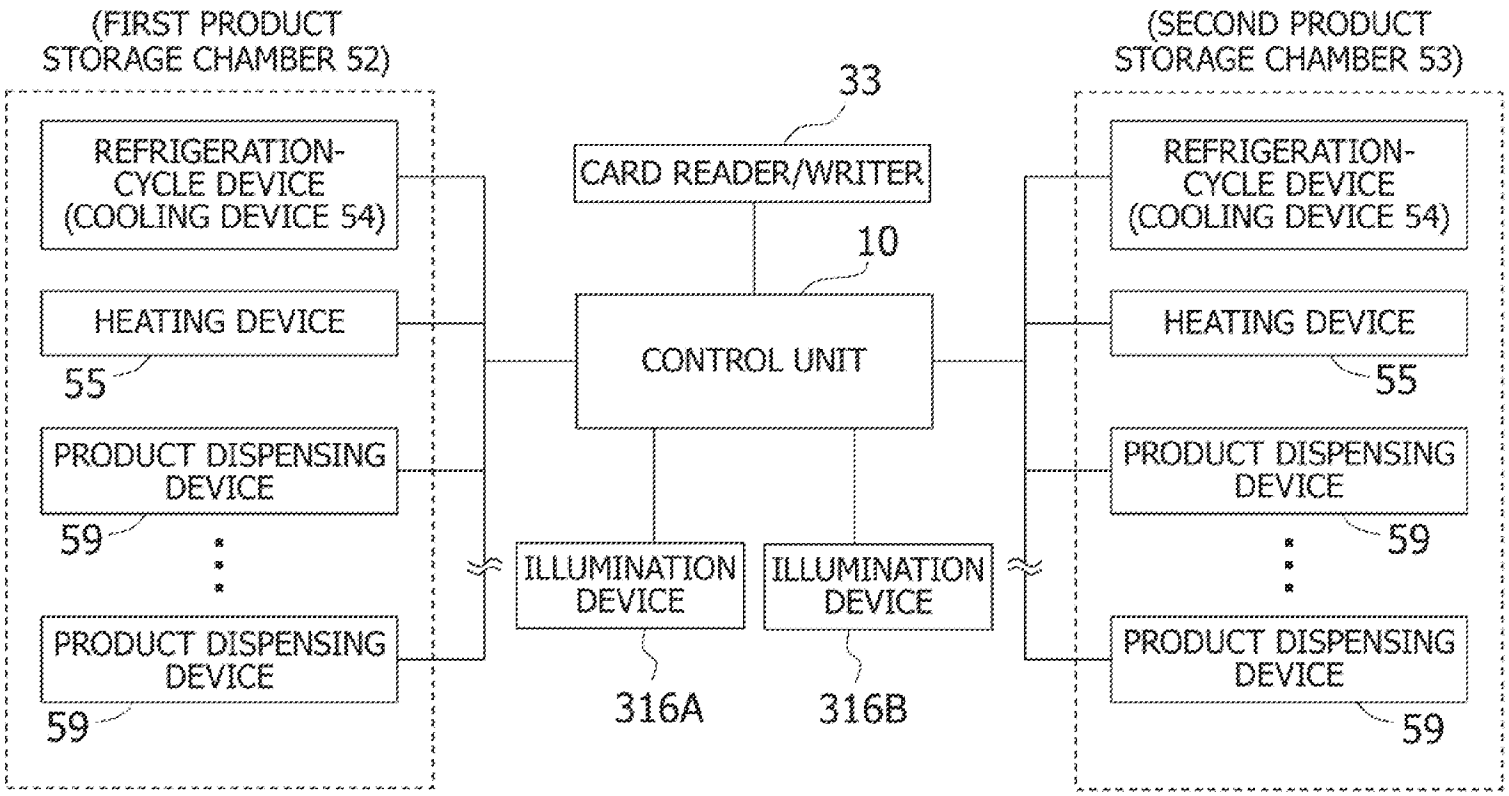
FIG. 4 is a control block diagram of the product storage device.

FIG. 4 is a control block diagram of the product storage device 1. The product storage device 1 includes a control unit 10 for controlling various operations of the product storage device 1. In the present embodiment, the control unit 10 is disposed on the back of the outer door 3 (see FIG. 2), and connected to the card reader/writer 33, the refrigeration-cycle devices including the cooling devices 54, the heating devices (heaters) 55, the product dispensing devices 59, and the pair of illumination devices 316A, 316B, via signal lines, or the like. In the present embodiment, the control unit 10 executes controls as follows.

First, the control unit 10 separately controls the refrigeration-cycle device for the first product storage chamber 52 and the refrigeration-cycle device for the second product storage chamber 53, or separately controls the heating device 55 for the first product storage chamber 52 and the heating device 55 for the second product storage chamber 53, so that the temperature inside the first product storage chamber 52 and that inside the second product storage chamber 53 become a predetermined set temperature (set cooling temperature or set heating temperature). The set temperature for the first product storage chamber 52 and that of the second product storage chamber 53 are the same, and can be input by an operation of an input device (not illustrated) by the operator or the like.

When cooling the interior of the first product storage chamber 52 and that of the second product storage chamber 53, that is, when cooling products P stored in the first and second product storage chambers 52, 53, the control unit 10 operates the refrigeration-cycle device for the first product storage chamber 52 so that the temperature inside the first product storage chamber 52 sensed by a temperature sensor (not illustrated) falls within a range of from a lower limit up to a higher limit of the set temperature (the set cooling temperature). Similarly, the control unit 10 operates the refrigeration-cycle device for the second product storage chamber 53 so that the temperature inside the second product storage chamber 53 sensed by a temperature sensor (not illustrated) falls within a range of from the lower limit up to the higher limit of the set temperature (the set cooling temperature).

When heating the interior of the first product storage chamber 52 and that of the second product storage chamber 53, that is, when heating products P stored in the first and second product storage chambers 52, 53, the control unit 10 operates the heating device 55 for the first product storage chamber 52 so that the temperature inside the first product storage chamber 52 sensed by a temperature sensor (not illustrated) falls within a range of from a lower limit up to a higher limit of the set temperature (the set heating temperature). Similarly, the control unit 10 operates the heating device 55 for the second product storage chamber 53 so that the temperature inside the second product storage chamber 53 sensed by a temperature sensor (not illustrated) falls within a range of from the lower limit up to the higher limit of the set temperature (the set heating temperature).

Furthermore, when the control unit 10 receives, from the card reader/writer 33, product information read by the card reader/writer 33 from a product designation card inserted into the card inlet 32, the control unit 10 outputs a product dispensing signal to the corresponding product dispensing device 59, that is, the product dispensing device 59 for the product passage 57 in which a product P corresponding to the received product information is stored. This operates the product dispensing device 59 that has received the product dispensing signal to drop the lowermost product P in the product passage 57. Thus, the product P corresponding to the product information read by the card reader/writer 33 is dispensed to the product delivery port 31.

Furthermore, in the present embodiment, the control unit 10 sets one of the first and second product storage chambers 52, 53 as a preliminary chamber in which stored products P are not available for dispensing, and sets the other of the first and second product storage chambers 52, 53 as a product dispensing chamber in which stored products P are available for dispensing. Then, the control unit 10 sequentially changes product storage chambers to be set as the preliminary chamber. In other words, the control unit 10 sets one of the first and second product storage chambers 52, 53 to a dispensing-discontinued state in which dispensing of stored products is discontinued, and sets the other of the first and second product storage chambers 52, 53 to a dispensing state in which dispensing of stored products can be performed. Then, the control unit 10 sequentially changes product storage chambers to be set to the dispensing-discontinued state. The control unit 10 may periodically changes product storage chambers to be set as the preliminary chamber (product storage chambers to be set to the dispensing-discontinued state). Furthermore, the control unit 10 may sequentially change product storage chambers to be set as the preliminary chamber based on an operation to the input device performed by the operator or the like, or may sequentially change product storage chambers to be set as the preliminary chamber at a predetermined changing timing. This makes the product storage device 1 possible to dispense only products stored in one of the first and second product storage chambers 52, 53 to the product delivery port 31.

For example, the control unit 10 sets the first product storage chamber 52 as the preliminary chamber and sets the second product storage chamber 53 as the product dispensing chamber. In this case, the control unit 10 does not output the product dispensing signal to the product dispensing devices 59 in the first product storage chamber 52 set as the preliminary chamber, but outputs the product dispensing signal to the corresponding product dispensing device 59 of the product dispensing devices 59 in the second product storage chamber 53 set as the product dispensing chamber. Then, when a predetermined time period elapses, the control unit 10 sets the second product storage chamber 53 as the preliminary chamber and sets the first product storage chamber 52 as the product dispensing chamber in response to the operation of the input device performed by the operator or the like, and then, when the predetermined time period again elapses, the control unit 10 sets the first product storage chamber 52 as the preliminary chamber and sets the second product storage chamber 53 as the product dispensing chamber in response to the operation of the input device performed by the operator or the like. The control unit 10 repeatedly performs such setting of the preliminary chamber and the product dispensing chamber. Thus, the product storage device 1 always includes the preliminary chamber and the product dispensing chamber, and these chambers are sequentially (in this case, periodically) switched. Here, the predetermined time period is not necessarily always constant, and may be appropriately changed depending on the external environment or the like. Alternatively, the control unit 10 may perform the abovementioned setting of the preliminary chamber and product dispensing chamber based on a built-in timer or the like. In this case, the predetermined time period may be appropriately set depending on a suitable temperature (the set temperature) of products P, or the like. Preferably, the predetermined time period is set to a time period required until the temperatures of not-cooled or -heated products P become suitable (the set temperature) after storing the products P in the first product storage chamber 52 or the second product storage chamber 53, or to a time period longer than the required time period.

Sequentially changing of product storage chambers to be set as the preliminary chamber in this way is performed to make the product storage device 1 possible to continuously dispense products P having a suitable temperature even when the suitable temperature range of products P is narrow. Thus, specifically, reloading of the product storage device 1 with products P is performed to a product storage chamber which is newly set as the preliminary chamber in accordance with the change of product storage chamber to be set as the preliminary chamber. This makes it possible to reload the product storage device 1 with products P without having effects on the temperature inside a product storage space set as the product dispensing chamber (i.e., the temperature state of product P which may be dispensed). Furthermore, the loaded products P can have the suitable temperature or a state close thereto, before the product storage chamber which has been set as the preliminary chamber is switched to the product dispensing chamber. Thus, the loaded product P can be immediately dispensed as a product P having a suitable temperature after switching from the preliminary chamber to the product dispensing chamber. Thus, even when a range of suitable temperatures of product P is narrow, the product storage device 1 is possible to dispense product P having a suitable temperature.

To reliably reload a product storage chamber set as the preliminary chamber with products P by the operator or the like, it is necessary to make the operator or the like understand which of the first product storage chamber 52 and second product storage chamber 53 is set as the preliminary chamber. Thus, in the present embodiment, the pair of illumination devices 316A, 316B for illuminating the interior of the product delivery port 31 is used to indicate a product storage chamber which has been set as the preliminary chamber. Specifically, as described below, the control unit 10 changes a combination of turning on and off of the pair of illumination devices 316A, 316B in association with the change of product storage chamber to be set as the preliminary chamber (i.e., the change of preliminary chamber), to make the pair of illumination devices 316A, 316B indicate a product storage chamber which has been set as the preliminary chamber.

Figure 5A:
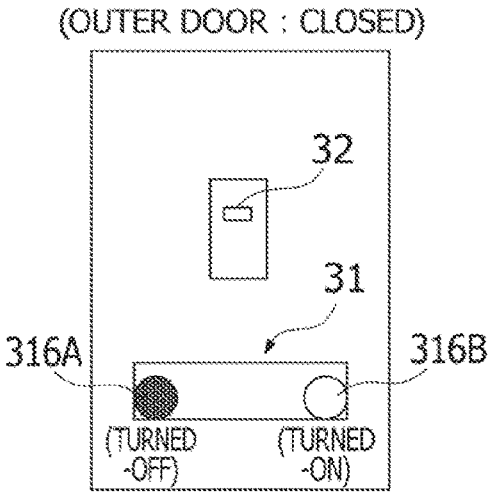
FIG. 5A is a diagram illustrating a control of a pair of illumination devices performed by a control unit of the product storage device (a diagram schematically illustrating a state of the product storage device (with the outer door closed) when viewed from the front).
Figure 5B:
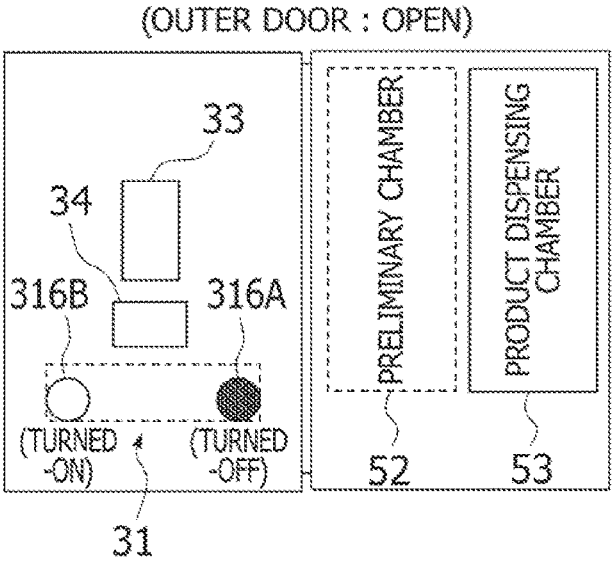
FIG. 5B is a diagram illustrating the control of the pair of illumination devices performed by the control unit of the product storage device (a diagram schematically illustrating a state of the product storage device (with the outer door open) when viewed from the front).
Figure 6A:
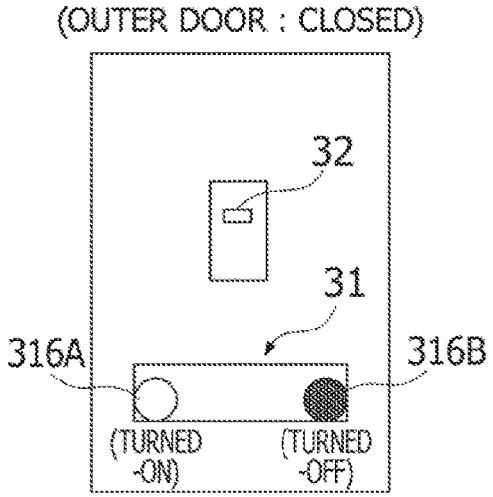
FIG. 6A is a diagram illustrating the control of the pair of illumination devices performed by the control unit of the product storage device (a diagram schematically illustrating a state of the product storage device (with the outer door closed) when viewed from the front).
Figure 6B:
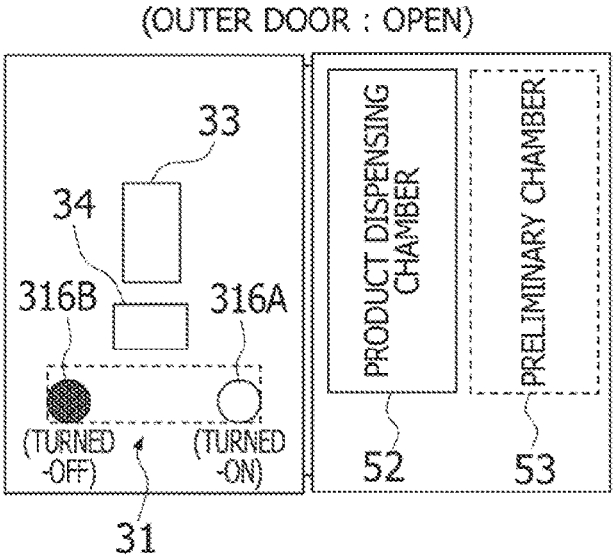
FIG. 6B is a diagram illustrating the control of the pair of illumination devices performed by the control unit of the product storage device (a diagram schematically illustrating a state of the product storage device (with the outer door open) when viewed from the front).

FIGS. 5A, 5B, 6A and 6B are diagrams illustrating a control of the pair of illumination devices 316A, 316B performed by the control unit 10. FIGS. 5A and 6A are explanatory diagrams each schematically illustrating a state of the product storage device 1 (with the outer door 3 closed) when viewed from the front. FIGS. 5B and 6B are explanatory diagrams each schematically illustrating a state in which the outer door 3 is open. As described above, the product storage device 1 includes the first product storage chamber 52 located on the left side when viewed from the front, and the second product storage chamber 53 located on the right side when viewed from the front. One of the pair of illumination devices 316A, 316B, that is, the illumination device 316A is located at the left side when viewed from the front similarly to the first product storage chamber 52, and the other, that is, the illumination device 316B is located at the right side when viewed from the front similarly to the second product storage chamber 53.

When the control unit 10 sets the first product storage chamber 52 as the preliminary chamber and sets the second product storage chamber 53 as the product dispensing chamber, the control unit 10 makes the illumination device 316B located at the right side when viewed from the front turned on, and the illumination device 316A located at the left side when viewed from the front turned off (FIG. 5A). Furthermore, the control unit 10 maintains the turning-on state of the illumination device 316B and the turning-off state of the illumination device 316A even when the outer door 3 is opened. In this case, a product P stored in the second product storage chamber 53 which has been set as the product dispensing chamber is dispensed to the product delivery port 31. Thus, turning on of the illumination device 316B can indicate where, in the product delivery port 31, a product P is to be dispensed (location at which product P will be delivered), and can efficiently illuminate the dispensed product P in the product delivery port 31.

Loading of products P is performed in a state in which the outer door 3 is open. Thus, when loading products P, the operator or the like will see the outer door 3 from the back thereof. In this situation, the turned-on illumination device 316B is located at the left side when viewed from the operator or the like, corresponding to the location of the first product storage chamber 52 which has been set as the preliminary chamber, whereas the turned-off illumination device 316A is located at the right side when viewed from the operator or the like, corresponding to the location of the second product storage chamber 53 which has been set as the product dispensing chamber (FIG. 5B). Thus, it is possible for the operator or the like to easily understand that the first product storage chamber 52 located on a side in which the turned-on illumination device 316B is located, that is, at the left side when viewed from the operator or the like is the preliminary chamber to which products P are to be loaded, by checking the illumination devices 316A, 316B when loading products P. This makes it possible to prevent the operator or the like from erroneously loading product P into the second product storage chamber 53 which has been set as the product dispensing chamber.

In contrast, when the control unit 10 sets the second product storage chamber 53 as the preliminary chamber and sets the first product storage chamber 52 as the product dispensing chamber, the control unit 10 makes the illumination device 316A located at the left side when viewed from the front turned on, and the illumination device 316B located at the right side when viewed from the front turned off (FIG. 6A). Furthermore, the control unit 10 maintains the turning-on state of the illumination device 316A and the turning-off state of the illumination device 316B even when the outer door 3 is opened. In this case, a product P stored in the first product storage chamber 52 is dispensed to the product delivery port 31. Thus, turning on of the illumination device 316A can indicate where, in the product delivery port 31, a product P is to be dispensed, and can efficiently illuminate the dispensed product P in the product delivery port 31.

The turned-on illumination device 316A is located at the right side when viewed from the operator or the like, who is going to load products P, corresponding to the location of the second product storage chamber 53 which has been set as the preliminary chamber (FIG. 6B). Thus, it is possible for the operator or the like to easily understand that the product storage chamber located on a side in which the turned-on illumination device 316A is located, that is, the second product storage chamber 53 located on the right side when viewed from the operator or the like is the preliminary chamber to which products P are to be loaded. This makes it possible for the operator or the like from erroneously loading products P into the first product storage chamber 52 which has been set as the product dispensing chamber.

Thus, in the embodiment described in the foregoing, the product storage device 1 includes the first and second product storage chambers 52, 53 for storing products P and for cooling or heating the stored products P, and the product storage device 1 is configured to dispense a product stored in the first or second product storage chamber 52, 53 to the product delivery port 31. The control unit 10 of the product storage device 1 sets one of the first and second product storage chambers 52, 53 as the preliminary chamber and sets the other of the first and second product storage chambers 52, 53 as the product dispensing chamber. Furthermore, the control unit 10 is configured to sequentially change product storage chambers to be set as the preliminary chamber. Thus, by changing product storage chambers to be set as the preliminary chamber by the control unit 10 at an appropriate timing, that is, by changing the preliminary chamber by the control unit 10 at an appropriate timing, and by loading products P into a product storage chamber which is newly set as the preliminary chamber in accordance with the changing timing of the preliminary chamber, the product storage device 1 is possible to continuously dispense product P having a suitable temperature even when the suitable temperature range of product P is narrow. Although not subject to any particular limitation, products with such a narrow range of suitable temperatures may be, for example, a bottled beverage that needs to be delivered in a supercooled state (supercooled beverage).

Furthermore, in the embodiment described above, the control unit 10 changes the combination of turning-on and -off of the pair of illumination devices 316A, 316B in association with the change of product storage chamber to be set as the preliminary chamber (i.e., the change of preliminary chamber), to make the pair of illumination devices 316A, 316B indicate which product storage chamber is set as the preliminary chamber at that time. Thus, without necessity of additional dedicated components, it is possible to make the operator or the like understand which of the first and second product storage chambers 52, 53 is set as the preliminary chamber, so that it is possible to prevent the operator or the like from erroneously loading product P into a product storage chamber which has been set as the product dispensing chamber.

In the embodiment described above, the pair of illumination devices 316A, 316B corresponds to "indicator" and "a plurality of light-emitting units" of the present invention.

In the embodiment described above, the product storage device 1 includes two product storage chambers (first and second product storage chambers 52, 53) arranged side by side in the width direction (right-and-left direction), and the control unit 10 sets one of the product storage chambers as the preliminary chamber and the other of the product storage chambers as the product dispensing chamber. The present invention is not limited thereto, and the product storage device 1 may have three product storage chambers arranged side by side in the width direction (right-and-left direction). In this case, for example, the control unit 10 may set any one of the three product storage chambers as the preliminary chamber, and set two others as the product dispensing chambers, and may periodically change product storage chambers to be set as the preliminary chamber.

Also in the case in which the product storage device 1 includes three product storage chambers, it is possible to make the pair of illumination devices 316A, 316B indicate which product storage chamber is set as the preliminary chamber at that time, by changing the combination of turning-on and -off of the pair of illumination devices 316A, 316B by the control unit 10 in association with the change of product storage chamber set as the preliminary chamber (i.e., the change of preliminary chamber). Hereinbelow, this will be described with reference to FIGS. 7 to 9. In the following description, a product storage chamber located on the left side when viewed from the front is a first product storage chamber 152, a product storage chamber located on the right side when viewed from the front is a second product storage chamber 153, and a product storage chamber located between the first and second product storage chambers 152, 153 is a third product storage chamber 154.

FIGS. 7A, 7B, 8A, 8B, 9A and 9B are diagrams illustrating a control of the pair of illumination devices 316A, 316B performed by the control unit 10 in a case in which the product storage device 1 includes three product storage chambers. Similarly to FIGS. 5A and 6A, FIGS. 7A, 8A and 9A are explanatory diagrams each schematically illustrating a state of the product storage device 1 (with the outer door 3 closed) when viewed from the front. Similarly to FIGS. 5B and 6B, FIGS. 7B, 8B and 9B are explanatory diagrams each schematically illustrating a state in which the outer door 3 is open.

Figure 7A:
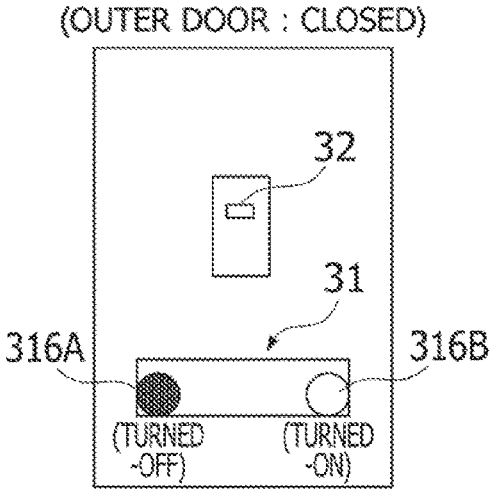
FIG. 7A is a diagram illustrating another control of the pair of illumination devices performed by the control unit of the product storage device (a diagram schematically illustrating a state of the product storage device (with the outer door closed) when viewed from the front).
Figure 7B:
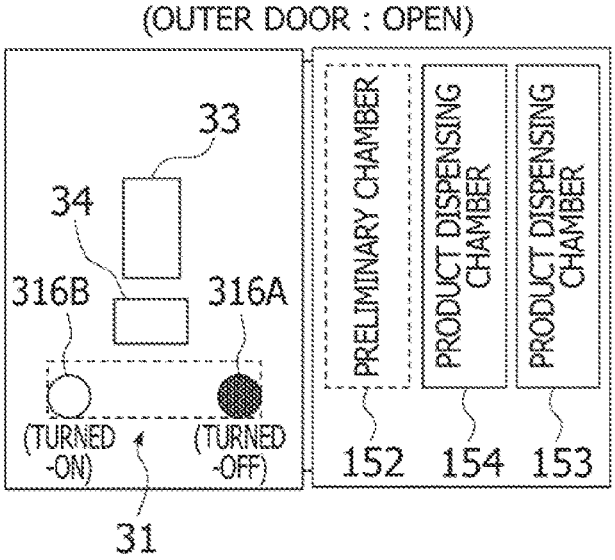
FIG. 7B is a diagram illustrating said another control of the pair of illumination devices performed by the control unit of the product storage device (a diagram schematically illustrating a state of the product storage device (with the outer door open) when viewed from the front).

When the control unit 10 sets the first product storage chamber 152 as the preliminary chamber and sets the second and third product storage chambers 153, 154 as the product dispensing chambers, the control unit 10 makes the illumination device 316B located at the right side when viewed from the front turned on, and the illumination device 316A located at the left side when viewed from the front turned off (FIG. 7A). Furthermore, the control unit 10 maintains the turning-on state of the illumination device 316B and the turning-off state of the illumination device 316A even when the outer door 3 is opened. In this case, a product P stored in the second or third product storage chamber 153, 154 which has been set as the product dispensing chamber is dispensed to the product delivery port 31. Thus, turning on of the illumination device 316B located at the right side when viewed from the front can efficiently illuminate the dispensed product P in the product delivery port 31. Furthermore, the turned-on illumination device 316B is located at the left side when viewed from the operator or the like, who is going to load products P, corresponding to the location of the first product storage chamber 152 which has been set as the preliminary chamber (FIG. 7B). Thus, it is possible for the operator or the like to easily understand that the product storage chamber located on a side in which the turned-on illumination device 316B is located, that is, the first product storage chamber 152 located on the left side when viewed from the operator or the like, is the preliminary chamber to which products P are to be loaded, when loading products P. This makes it possible to prevent the operator or the like from erroneously loading products P into the second or third product storage chamber 153, 154 which has been set as the product dispensing chamber.

Figure 8A:
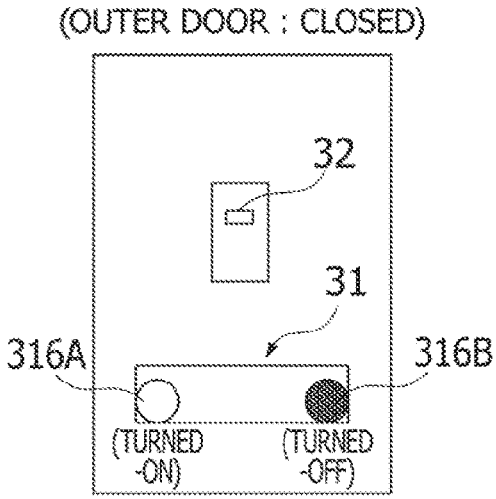
FIG. 8A is a diagram illustrating said another control of the pair of illumination devices performed by the control unit of the product storage device (a diagram schematically illustrating a state of the product storage device (with the outer door closed) when viewed from the front).
Figure 8B:
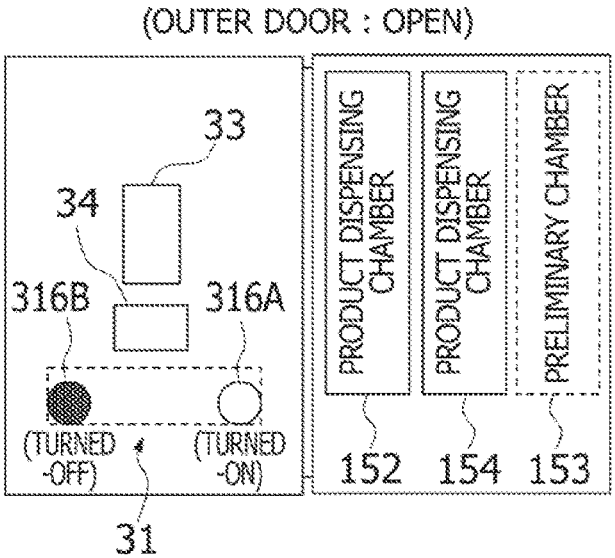
FIG. 8B is a diagram illustrating said another control of the pair of illumination devices performed by the control unit of the product storage device (a diagram schematically illustrating a state of the product storage device (with the outer door open) when viewed from the front).

When the control unit 10 sets the second product storage chamber 153 as the preliminary chamber and sets the first and third product storage chambers 152, 154 as the product dispensing chambers, the control unit 10 makes the illumination device 316A located at the left side when viewed from the front turned on, and the illumination device 316B located at the right side when viewed from the front turned off (FIG. 8A). Furthermore, the control unit 10 maintains the turning-on state of the illumination device 316A and the turning-off state of the illumination device 316B even when the outer door 3 is opened. In this case, a product P stored in the first or third product storage chamber 152, 154 is dispensed to the product delivery port 31. Thus, turning on of the illumination device 316A located at the left side when viewed from the front can efficiently illuminate the dispensed product P in the product delivery port 31. Furthermore, the turned-on illumination device 316A is located at the right side when viewed from the operator or the like, who is going to load products P, corresponding to the location of the second product storage chamber 153 which has been set as the preliminary chamber (FIG. 8B). Thus, it is possible for the operator or the like to easily understand that the product storage chamber located on a side in which the turned-on illumination device 316A is located, that is, the second product storage chamber 153 located on the right side when viewed from the front, is the preliminary chamber to which products P are to be loaded, when loading products P. This makes it possible to prevent the operator or the like from erroneously loading products P into the first or third product storage chamber 152, 154 which has been set as the product dispensing chamber.

Figure 9A:
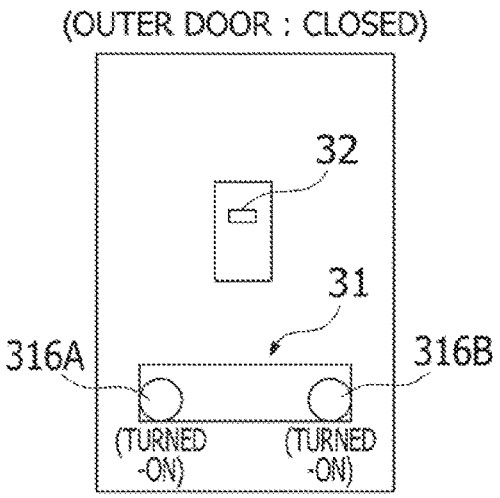
FIG. 9A is a diagram illustrating said another control of the pair of illumination devices performed by the control unit of the product storage device (a diagram schematically illustrating a state of the product storage device (with the outer door closed) when viewed from the front).
Figure 9B:
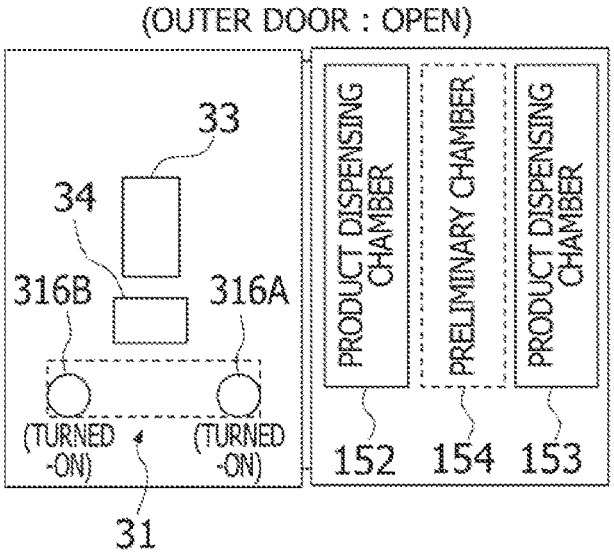
FIG. 9B is a diagram illustrating said another control of the pair of illumination devices performed by the control unit of the product storage device (a diagram schematically illustrating a state of the product storage device (with the outer door open) when viewed from the front).

When the control unit 10 sets the third product storage chamber 154 as the preliminary chamber and sets the first and second product storage chambers 152, 153 as the product dispensing chambers, the control unit 10 makes both of the pair of illumination devices 316A, 316B turned on (FIG. 9A). Furthermore, the control unit 10 maintains the turning-on state of the illumination devices 316A, 316B even when the outer door 3 is opened. In this case, a product P stored in the first or second product storage chamber 152, 153 is dispensed to the product delivery port 31. Thus, turning on of both of the pair of illumination devices 316A, 316B can surely illuminate the dispensed product P in the product delivery port 31. Furthermore, in this case, although the operator or the like will observe that both of the pair of illumination devices 316A, 316B are turned on, the number of the product storage chamber set as the preliminary chamber is only one. Thus, it is possible for the operator or the like to understand that the third product storage chamber 154 that does not correspond to any of the turned-on illumination devices 316A, 316B is the preliminary chamber to which products P are to be loaded. This makes it possible to prevent the operator or the like from erroneously loading products P into the first or second product storage chamber 152, 153 which has been set as the product dispensing chamber.

Figure 10:
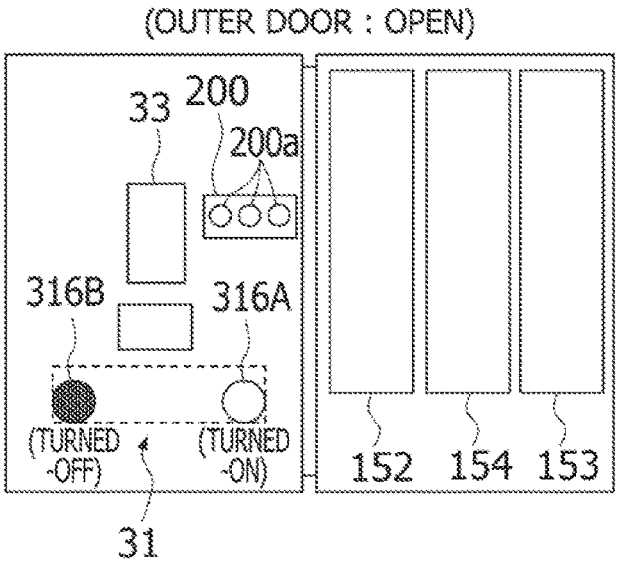
FIG. 10 is a diagram illustrating a modification of the product storage device.

Although, in the foregoing, the pair of illumination devices 316A, 316B for illuminating the interior of the product delivery port 31 indicates which product storage chamber is set as the preliminary chamber at that time, the present invention is not limited thereto. For example, as illustrated in FIG. 10, the product storage device 1 may include an indicator 200 having a plurality of (but the same as the number of the product storage chambers; in this case, three) light-emitting units 200*a* disposed on the back of the outer door 3. For example, the light-emitting units 200*a* may be LEDs. In this case, the product storage device 1 may include at least three product storage chambers and each of the plurality of light-emitting units 200*a* is provided so as to correspond to the corresponding product storage chamber. Furthermore, when the product storage device 1 includes at least four product storage chambers, the control unit 10 may set two product storage chambers as the preliminary chambers.

The control unit 10 may make the indicator 200 indicate a product storage chamber set as the preliminary chamber at that time by changing the combination of turning-on and -off of the plurality of light-emitting units 200*a* of the indicator 200 in association with the change of product storage chamber to be set as the preliminary chamber (i.e., the change of preliminary chamber). For example, the control unit 10 turns on a light-emitting unit 200*a* corresponding to a product storage chamber set as the preliminary chamber and turns off light-emitting units 200*a* corresponding to product storage chambers set as the product dispensing chambers, to make the indicator 200 indicate which product storage chamber is set as the preliminary chamber at that time. Alternatively, the control unit 10 may turn off light-emitting unit 200*a* corresponding to a product storage chamber set as the preliminary chamber and turn on light-emitting units 200*a* corresponding to the product dispensing chambers, to make the indicator 200 indicate which product storage chamber is set as the preliminary chamber.

Although the details are not described herein, it will be apparent to one skilled in the art that, for example, an indicating board for indicating the preliminary chamber and/or the product dispensing chamber may be appropriately installed instead of the pair of illumination devices 316A, 316B or the indicator 200, to indicate which product storage chamber is set as the preliminary chamber at that time.

Although the embodiments and modifications of the present invention have been described in the foregoing, the present invention is not limited thereto, and further modifications and changes can be made based on the technical concept of the present invention.

REFERENCE SYMBOL LIST

1 Product storage device
5 Product storage space
10 Control unit
31 Product delivery port
52, 152 First product storage chamber
53, 153 Second product storage chamber
54 Cooling device
55 Heating device
59 Product dispensing device
154 Third product storage chamber
316A, 316B Illumination devices
P Product

The invention claimed is:

1. A product storage device comprising:

a plurality of product storage chambers for storing products and for cooling the stored products;

a product delivery port to which a product stored in the plurality of product storage chambers is dispensed;

a control unit configured to set at least one, but not all, of the plurality of product storage chambers as a preliminary chamber in which stored products are not available for dispensing and set the remainder as a product dispensing chamber in which stored products are available for dispensing, and configured to sequentially change product storage chambers to be set as the preliminary chamber;

wherein the product is a bottled supercooled beverage dispensed to the product delivery port in a supercooled state; and wherein the preliminary chamber and the product dispensing chamber always exist.

2. The product storage device according to claim 1, wherein the control unit periodically changes product storage chambers to be set as the preliminary chamber.

3. The product storage device according to claim 1, wherein the control unit sequentially changes product storage chambers to be set as the preliminary chamber based on an input operation of an operator.

4. The product storage device according to claim 1, wherein each of the plurality of product storage chambers is provided with a cooling device, wherein the control unit controls the cooling device of each product storage chamber to make temperatures inside the plurality of product storage chambers the same.

5. The product storage device according to claim 1, further comprising an indicator for indicating a product storage chamber which has been set as the preliminary chamber.

6. The product storage device according to claim 5, further comprising a pair of illumination devices that is arranged at both sides in the product delivery port and illuminates the interior of the product delivery port, wherein the control unit changes a combination of turning on and off of the pair of illumination devices in association with the change of product storage chambers to be set as the preliminary chamber.

7. The product storage device according to claim 1, further comprising a plurality of light-emitting units, each light-emitting unit being capable of being turned on and off independently, wherein the control unit changes a combination of turning on and off of the plurality of light-emitting units in association with the change of product storage chambers to be set as the preliminary chamber.

8. The product storage device according to claim 1, wherein the plurality of product storage chambers comprises a first product storage chamber and a second product storage chamber, wherein the control unit sets one of the first and second product storage chambers as the preliminary chamber and sets the other as the product dispensing chamber.

9. The product storage device according to claim 8, further comprising a pair of illumination devices that is arranged at both sides in the product delivery port and illuminates the interior of the product delivery port, wherein the control unit changes a combination of turning on and off of the pair of illumination devices in association with the change of product storage chambers to be set as the preliminary chamber.

10. The product storage device according to claim 1, wherein the plurality of product storage chambers comprises first, second and third product storage chambers, wherein the control unit sets one of the first, second and third product storage chambers as the preliminary chamber and set the others as the product dispensing chambers.

* * * * *